United States Patent [19]

Herbst

[11] 4,147,135

[45] Apr. 3, 1979

[54] DEVICE FOR REDUCING FLUE GAS HEAT LOSSES

[76] Inventor: Donald Herbst, Marienplatz 11, 1 Berlin 45, Fed. Rep. of Germany

[21] Appl. No.: 835,667

[22] Filed: Sep. 22, 1977

[30] Foreign Application Priority Data

Oct. 25, 1976 [DE] Fed. Rep. of Germany ..... 2648854

[51] Int. Cl.[2] ..... F22D 1/00

[52] U.S. Cl. ..... 122/412; 122/421; 165/105; 165/134 DP

[58] Field of Search ..... 165/105, 134 DP, DIG. 12; 122/421, 412; 110/302

[56] References Cited

U.S. PATENT DOCUMENTS

| | | | |
|---|---|---|---|
| 1,612,854 | 1/1927 | Broido | 122/412 |
| 2,153,942 | 4/1939 | Spalding, Jr. | 165/105 X |
| 2,623,506 | 12/1952 | Dalin et al. | 122/412 |
| 2,681,047 | 6/1954 | Dalin et al. | 122/412 X |
| 2,854,220 | 9/1958 | Vaughan | 165/134 DP X |
| 3,993,244 | 11/1976 | Taylor | 165/105 X |
| 4,029,142 | 6/1977 | Van Beubering | 165/134 DP X |

*Primary Examiner*—Albert W. Davis, Jr.
*Attorney, Agent, or Firm*—Basile and Weintraub

[57] ABSTRACT

A device for the reduction of heat losses due to flue gasses in boilers of the type having a flue and which are operated with oil or gas and wherein the boiler has a heat exchanger in the flue serving to reduce the temperature of the flue gases. A heat pipe having a U-shaped configuration is disposed in the flue with the heat exchanger being positioned between the pipe ends, and the warm side of the heat pipe is between the boiler and the heat exchanger.

4 Claims, 3 Drawing Figures

DEVICE FOR REDUCING FLUE GAS HEAT LOSSES

BACKGROUND OF THE INVENTION

I. Field of the Invention

The present invention relates to a device for the reduction of heat losses due to flue gases in boilers which are operated with oil or gas.

II. Description of the Prior Art

When oil or gas is burned in a boiler, water vapor will result due to the hydrogen with water which was contained in the fuel. This water vapor precipitates from the flue gas if the temperature falls to a temperature below the due point. In case of the sulfur containing heating oils which are preferably used for the operation of boilers, the due point is located at approximately 150° C. The boiler and the burner must therefore be constructed and operated in such a way that the temperature of the flue gases does not fall below the due point temperature in any part of the installation; that is, up to the end of the smokestack. In order to have available at the end of the smokestack a flue gas temperature of at least 150° C., the flue gas temperature at the end of the boiler is approximately 210° C. to 270° C. If the boiler is operated in such a way that the high heat capacity of the flue gas is not taken advantage of, heat losses of various types result which can amount to 20% to 30%, depending upon the construction of the boiler, in comparison to a heating installation where the flue gas would leave the boiler at a temperature of approximately 20° C. The resulting heat loss is a combination of the flue gas loss which exists due to the high temperature of the flue gases. Another heat loss results because of unburned carbon monoxide. This loss can, of course, be prevented if an amount of air is available which is sufficient for the complete combustion of the carbon monoxide. However, since in this case the flue gas losses are substantially increased, a loss of carbon monoxide in the amount of 0.5% to 1.5% must be considered tolerable. Another source of losses is due to the fact that the heat of condensation of the water vapor that is contained in the flue gas is not taken advantage of in order to reduce these heat losses. Heat losses may be reduced by a heat exchanger located behind the boiler, for instance, in the form of tubes through which heating water is passed and subsequently returned to the boiler. This heat exchanger removes heat from the flue gas, which heat is used for the preheating of the heating water with the result that the flue gases in the area of the heat exchanger are cooled; and, thus, the heating water in the heat exchanger is heated corresponding to the degree of cooling. If a corrosion-resistant heat exchanger is used, a temperature below the due point temperature of 150° C. can actually be reached when the flue gases are cooled. In this case the water vapor which has condensed and formed liquid water precipitates at the heat exchanger and the precipitated water is collected, neutralized and removed after it has been further cooled. If the return temperature of the heating water through the boiler is 60° C., the temperature of the flue gases could be reduced to approximately 70° C., in which case the dew point temperature also is 70° C. In this case the flue gases behind the heat exchanger are present in the form of 100% saturation such that for any further cooling a further precipitation of condensed water will result; however, since the flue gases after leaving the heat exchanger and on their way into the free environment are necessarily subjected to further cooling, a cooling of the flue gases to 70° C. can actually not be achieved by using a heat exchanger, but rather the flue gas which leaves the heat exchanger must exhibit a temperature which exceeds the dew point of 150° C. to such an extent that a precipitation of condensed water is prevented up to the end of the smokestack. Therefore, the flue gas temperature can actually not be reduced to the optimal value of 70° C. by means of the heat exchanger when the hot water temperature is 60° C., but rather cooling can only be achieved up to a correspondingly higher temperature, such as 200° C., in order to prevent a precipitation of condensed water after leaving the heat exchanger.

III. Prior Art Statement

In the opinion of the applicant, the aforementioned description represents the most pertinent prior art of which applicant is aware.

SUMMARY OF THE INVENTION

This is the starting point for the invention which is based on the objective to decrease the flue gas temperature by using a heat exchanger until the dew point temperature has been reached and without precipitation of condensed water in the smokestack from the flue gas after leaving the heat exchanger.

This problem is solved in such a way that one or several heat pipes are provided which are actually known and which form a series of heat pipes which are, for instance, bent in the shape of the letter "U" in such a way that the heat exchanger is enclosed between both their ends and where the warm side of the heat pipes is located between the boiler and the heat exchanger. The invention is based on the fact that the applicant has recognized that the flue gases can be heated to such an extent after leaving the heat exchanger by means of a series of heat pipes that they can be passed into the smokestack without danger of precipitation of condensed water. If the heat pipes are applied in accordance with the invention, the flue gases can be cooled by means of the heat exchange down to a low temperature which represents an optimum with respect to the temperature of the heating water, such as of 70° C., since the series of heat pipes subsequently heats the flue gases to a temperature of, for instance, 100° C. which will prevent the precipitation of condensed water.

Heat pipes are actually known. They represent pipes which are filled with a refrigerant and which pipes serve to transfer heat from one side of the pipe to the other side. On the warm side the refrigerant will evaporate and thus, will absorb heat. Then the refrigerant will flow to the cold side and will condense, and in this way the absorbed heat will be freed again. The refrigerant which was liquified by condensation flows from the cold side back to the warm side by means of capillary action, and the cycle starts at the beginning. The heat pipes are bent in such a way and arranged to form a series such that heat is removed from the flue gas before the heat exchanger, that is, on the near side with reference to the boiler, which heat is transferred to the flue gas again after passing around the heat exchanger. Appropriate construction of the heat pipes results, therefore, in the heating of the flue gases behind the heat exchanger to such an extent that a temperature below the dew point is not reached during the cooling that will necessarily result in the smokestack.

For a flue gas temperature of, for instance, 270° C. at the exit of the boiler and a temperature of, for instance, 60° C. of the heating water which enters the heat exchanger, the flue gas temperature is reduced from 270° C. to approximately 240° C. by means of the warm side of the heat tubes whereas the flue gas temperature at the end of the heat exchanger is 70° C. The temperature difference between 270° C. and 240° C. which was absorbed at the warm side of the heat pipes is transferred to the cold side such that the temperature of the flue gases is increased from 70° C. to 100° C.

The cooling of the flue gases in the smokestack is dependent on the temperature difference between the flue gas and the free environment. The lower the flue gas has been cooled in the heat exchanger, the smaller is the amount of subsequent heating that is necessary in order to prevent a too low temperature in the smokestack. The performance of the heat exchanger changes depending on the return temperature of the heating water; the lower the temperature of the heating water which enters the heat exchanger, the higher is the performance of the heat exchanger and, therefore, the greater the effect of cooling of the flue gases. In case of increased cooling of the flue gases, the temperature difference between the flue gas and the heat pipe behind the heat exchanger increases therefore and also the heating effect of the heating pipe, thus resulting in an unnecessarily high reheating of the flue gases after the heat exchanger.

In order to adapt the degree of reheating of the flue gases behind the heat exchanger to the different performance of the heat exchanger depending upon the temperature of the added heating water, the invention is further characterized by the fact that the heat exchanger consists of at least two branches which are located in a row in the flue and that the heat tube corresponds with the far side of the branch of the heat exchanger with reference to the boiler. Since the warm side of the heat pipe is located between the two branches of the heat exchanger, changes in the performance of the heat exchanger can be partially sensed by the heat pipe with its warm side in such a way that an automatic adaptation of the heating effect of the heat pipe and therefore the degree of reheating of the flue gases reference to the performance of the heat exchanger is warranted. If heating water from one return source only enters the heat exchanger, both of the branches of the heat exchanger are connected in a row.

However, it is the rule that in the case of central heating equipment, the pipes of various groups of various return temperatures enter the boiler and are only combined at the return collector. It is the rule that warm water heaters exhibit lower return temperatures than floor heaters, and these again lower temperatures than radiator heaters. In order to avoid losses due to mixing, in this case the branches of the heat exchanger are connected in a parallel manner and are located in a row in the stream of the flue gas. The return water of one or several groups which exhibit the same return temperature passes each branch of the heat exchanger in such a way that the coldest heating water passes through the far branch of the heat exchanger with reference to the direction of flow of the flue gases. The individual branches are combined after the heat exchanger. Here, again, the heat pipe responds to the far branch of the heat exchanger with reference to the direction of flow.

BRIEF DESCRIPTION OF THE DRAWING

The attached drawing shows examples of versions of the invention.

DESCRIPTION OF THE PREFERRED EMBODIMENTS

Figure 1:
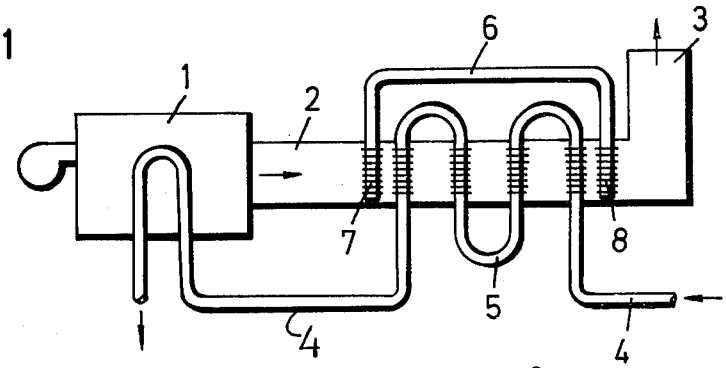
FIG. 1 shows the schematic view of the device with a heat tube that is located above the heat exchanger and extends with both ends on both sides of the heat exchanger.
Figure 2:
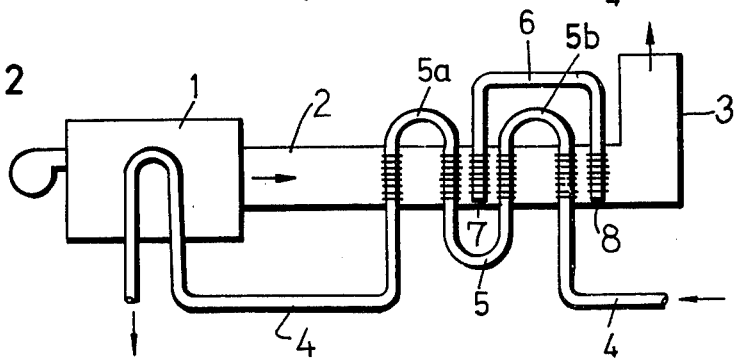
FIG. 2 shows a view according to FIG. 1 with a heat pipe which extends over the last branch of the heat exchanger.

FIG. 1 shows in schematic view a boiler 1 which is oil fired and wherein the flue 2 of the boiler 1 ends in a smokestack 3. The heating water enters the boiler 1 by means of the return or heating pipe 4 for the purpose of heating. A ribbed heat exchanger 5 is located in the heating pipe 4 which, in turn, is located in the flue 2. The heating water is subjected to a preheating effect while passing the heat exchanger 5 and under cooling of the temperature of the flue gases. A heat pipe 6 corresponds with the heat exchanger 5. Heat pipe 6 is located above the heat exchanger 5 and extends on either side of the heat exchanger 5. The heat pipe 6 is shaped in the shape of the letter "U" in such a way that it is positioned with its ends 7 and 8 in the flue 2 before and behind the heat exchanger 5. The warm side 7 of the heat tube 6 is heated by means of the flue gases, and the heat is transferred to the cold end 8. This causes a reheating of the flue gases which leave the heat exchanger 5 in order to prevent the precipitation of condensed water in the smokestack 3. In case of the version according to FIG. 2, the heat pipe 6 corresponds with the far branch 5*b* of the heat exchanger 5 with reference to the direction of flow of the flue gases in such a way that the warm side 7 of the heat tube 6 is located between the branches 5*a* and 5*b* and is subjected to the flue gas which was already partially cooled by the branch 5*a* of the heat exchanger 5 and, thus, is heated independent of the performance of the heat exchanger 5, which heat is transferred to the cold end 8 of the heat pipe 6.

Figure 3:
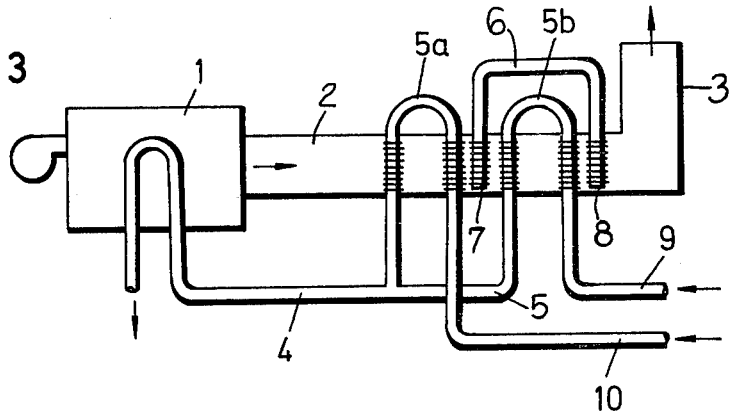
FIG. 3 shows a view in accordance with FIG. 2 whereas the branches of the heat exchanger are located in series.

In case of FIG. 3, both the branches 5*a* and 5*b* of the heat exchanger 5 are also located in a row in the stream of the flue gases; however, they are connected parallel with reference to each other by means of the pipe 9 which leads to branch 5*b* and by means of pipe 10 which leads to branch 5*a*. This is done at a point before the heating waters of various temperatures enter the boiler 1 through a common heating pipe 4. Here again, the heat pipe 6 corresponds with the far positioned branch 5*b* of the heat exchanger 5 with reference to the direction of flow of the flue gases in order to adapt the degree of subsequent heating of the flue gases by the cold side 8 of the heat pipe 6 to the performance of the heat exchanger 5.

While several examples of applicant's invention have been disclosed, it should be understood by those skilled in the field that other forms of applicant's invention may be had, all coming within the spirit of the invention and scope of the appended claims.

What is claimed is as follows:

1. A device for the reduction of the heat losses due to flue gases in boilers having a flue and which are operated with oil or gas comprising:

a heat exchanger located in said boiler flue, said heat exchanger serving for the reduction of the temperature of the flue gases and through which water from the boiler is passed; and a heat pipe having opposite, longitudinally spaced ends in said flue, said heat exchanger being positioned between said heat pipe ends and wherein the warm side of the heat tube is located between the boiler and the heat exchanger.

2. The device according to claim 1 characterized by the fact that the heat exchanger consists of at least two branches which are located in the flue in a row and that the heat pipe corresponds with the far branch of the heat exchanger with reference to the boiler.

3. The device according to claim 2 characterized by the fact that the branches of the heat exchanger are located in a row.

4. The device according to claim 2 characterized by the fact that the branches of the heat exchanger are located in a series.

* * * * *